US009634409B2

(12) United States Patent
Tsai et al.

(10) Patent No.: US 9,634,409 B2
(45) Date of Patent: Apr. 25, 2017

(54) ELECTRICAL CONNECTOR RECEPTACLE WITH COMBINED FIRST AND SECOND CONTACTS

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Long-Fei Chen, New Taipei (TW); Chien-Tsung Chuang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/176,695

(22) Filed: Jun. 8, 2016

(65) Prior Publication Data

US 2016/0365655 A1 Dec. 15, 2016

(30) Foreign Application Priority Data

Jun. 10, 2015 (CN) ..... 2015 1 0314909

(51) Int. Cl.
*H01R 12/71* (2011.01)
*H01R 12/72* (2011.01)
(Continued)

(52) U.S. Cl.
CPC ..... *H01R 12/716* (2013.01); *H01R 12/724* (2013.01); *H01R 13/6461* (2013.01); *H01R 13/6581* (2013.01); *H01R 24/64* (2013.01); *H01R 43/0256* (2013.01); *H01R 12/58* (2013.01); *H01R 13/648* (2013.01); *H01R 13/658* (2013.01); *H01R 13/6585* (2013.01); *H01R 13/6587* (2013.01);
(Continued)

(58) Field of Classification Search
CPC ..... H01R 13/6587; H01R 13/6594; H01R 23/6873; H01R 43/0235; H01R 43/0256; H01R 13/6595; H01R 13/658; H01R 13/6585; H01R 23/688; H01R 13/648; H01R 13/6581; H01R 12/724; H01R 23/7073
USPC ..... 439/79, 82, 607.01, 607.05, 607.4, 660
See application file for complete search history.

(56) References Cited

U.S. PATENT DOCUMENTS

2015/0079843 A1* 3/2015 Nakashima ..... H01R 13/6585 439/607.09

* cited by examiner

*Primary Examiner* — Abdullah Riyami
*Assistant Examiner* — Justin Kratt
(74) *Attorney, Agent, or Firm* — Muncy, Geissler, Olds & Lowe, P.C.

(57) ABSTRACT

An electrical receptacle connector includes a metallic shell, an insulated housing, a plurality of first receptacle terminals, and a plurality of second receptacle terminals. The insulated housing received in the metallic shell is assembled with the first receptacle terminals and the second receptacle terminals. The tail portion of the power terminal of the second receptacle terminals is adjacent to and combined with the tail portion of the power terminal of the first receptacle terminals. The tail portion of the ground terminal of the second receptacle terminals is adjacent to and combined with the tail portion of the ground terminal of the first receptacle terminals. The combined tail portions can be inserted into the same soldering hole of a circuit board. Therefore, the cost and time for the soldering procedure of the connector manufacturing can be reduced.

14 Claims, 16 Drawing Sheets

(51) Int. Cl.

| | |
|---|---|
| ***H01R 13/6461*** | (2011.01) |
| ***H01R 13/6581*** | (2011.01) |
| ***H01R 24/64*** | (2011.01) |
| *H01R 43/02* | (2006.01) |
| *H01R 12/50* | (2011.01) |
| *H01R 13/6587* | (2011.01) |
| *H01R 13/658* | (2011.01) |
| *H01R 13/6595* | (2011.01) |
| *H01R 13/6585* | (2011.01) |
| *H01R 13/6594* | (2011.01) |
| *H01R 13/648* | (2006.01) |
| *H01R 12/58* | (2011.01) |
| *H01R 107/00* | (2006.01) |

(52) U.S. Cl.

CPC ..... *H01R 13/6594* (2013.01); *H01R 13/6595* (2013.01); *H01R 23/688* (2013.01); *H01R 23/7073* (2013.01); *H01R 43/0235* (2013.01); *H01R 2107/00* (2013.01)

100

100

| | | | | | | | | | | | | |
|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 15

ELECTRICAL CONNECTOR RECEPTACLE WITH COMBINED FIRST AND SECOND CONTACTS

CROSS-REFERENCES TO RELATED APPLICATIONS

This non-provisional application claims priority under 35 U.S.C. §119(a) on Patent Application No. 201510314909.9 filed in China, P.R.C. on 2015 Jun. 10, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core.

SUMMARY OF THE INVENTION

Conventionally, the upper receptacle terminals include a plurality of upper tail portions extending out of the plastic core, and the lower receptacle terminals include a plurality of lower tail portions extending out the plastic core. The upper tail portions and the lower tail portions are separately soldered to soldering holes of a circuit board. Therefore, the soldering procedure is time consuming. For instance, several processes may be applied to the circuit board for making the soldering holes corresponding to the upper tail portions and the lower tail portions. In addition, applied solders have to cover the upper tail portions and the lower tail portions to allow the tail portions to be in contact with the soldering holes. When the applied solders fail to make any of the tail portions be in contact with the soldering holes, the conventional connector would be unable to perform power or signal transmission.

Accordingly, how to improve the existing connector becomes an issue.

In view of this, an embodiment of the instant disclosure provides an electrical receptacle connector. The electrical receptacle connector comprises a metallic shell, an insulated housing, a plurality of first receptacle terminals, and a plurality of second receptacle terminals. The metallic shell comprises a shell body and a receptacle cavity formed in the shell body. The insulated housing is received in the receptacle cavity. The insulated housing comprises a base portion and a tongue portion extending from one of two sides of the base portion. The tongue portion has a first surface (i.e., upper surface) and a second surface (i.e., lower surface) opposite to the first surface. The first receptacle terminals comprise a plurality of first signal terminals, at least one power terminal, and at least one ground terminal. Each of the first receptacle terminals is held in the insulated housing and disposed at the first surface. Each of the first receptacle terminals comprises a flat contact portion, a body portion, and a tail portion. The body portion is held in the base portion and disposed at the first surface of the tongue portion. The flat contact portion is extending forward from the body portion in the rear-to-front direction and partly exposed upon the first surface of the tongue portion. The tail portion is extending backward from the body portion in the front-to-rear direction and extending out of the base portion. The tail portion of the power terminal of the first receptacle terminals is substantially perpendicularly extending from the body portion and extending out of the base portion. The second receptacle terminals comprise a plurality of second signal terminals, at least one power terminal, and at least one ground terminal. Each of the second receptacle terminals is held in the insulated housing and disposed at the second surface. Each of the second receptacle terminals comprises a flat contact portion, a body portion, and a tail portion. The body is held in the base portion and disposed at the second surface of the tongue portion. The flat contact portion is extending forward from the body portion in the rear-to-front direction and partly exposed upon the second surface of the tongue portion. The tail portion is extending backward from the body portion in the front-to-rear direction and extending out of the base portion. The tail portion of the power terminal of the second receptacle terminals is substantially perpendicularly extending from the body portion and extending out of the base portion, and the tail portion of the power terminal of the second receptacle terminals is adjacent to and combined with the tail portion of the power terminal of the first receptacle terminals.

In one embodiment, one surface of the tail portion of the power terminal of the second receptacle terminals is in contact with one surface of the tail portion of the power terminal of the first receptacle terminals.

In one embodiment, one surface of the tail portion of the power terminal of the second receptacle terminals is spaced from one surface of the tail portion of the power terminal of the first receptacle terminals by a gap.

In one embodiment, the electrical receptacle connector further comprises a circuit board. The circuit board comprises a plurality of first soldering holes and a plurality of second soldering holes. Except the tail portion of the power terminal of the first receptacle terminals and except the tail portion of the power terminal of the second receptacle terminals, rest of the tail portions of the first receptacle terminals and the tail portions of the second receptacle terminals are inserted into the first soldering holes. The tail portion of the power terminal of the first receptacle terminals and the tail portion of the power terminal of the second receptacle terminals are inserted into the second soldering holes. The diameter of each of the first soldering holes is less than the diameter of each of the second soldering holes.

In one embodiment, the electrical receptacle connector further comprises a grounding plate at the insulated housing.

The grounding plate comprises a plate body and a plurality of legs, the plate body is between the flat contact portions of the first receptacle terminals and the flat contact portions of the second receptacle terminals. The legs are extending outward from two sides of the plate body and extending out of the insulated housing. In addition, each of the legs of the grounding plate is adjacent to and combined with at least one of the tail portion of the power terminal of the first receptacle terminals and the tail portion of the power terminal of the second receptacle terminals.

In one embodiment, the first receptacle terminals and the second receptacle terminals have 180 degree symmetrical design with respect to a central point of the receptacle cavity as the symmetrical center.

In one embodiment, the position of the flat contact portions of the first receptacle terminals corresponds to the position of the flat contact portions of the second receptacle terminals.

Another embodiment of the instant disclosure provides an electrical receptacle connector. The electrical receptacle connector comprises a metallic shell, an insulated housing, a plurality of first receptacle terminals, and a plurality of second receptacle terminals. The metallic shell comprises a shell body and a receptacle cavity formed in the shell body. The insulated housing is received in the receptacle cavity. The insulated housing comprises a base portion and a tongue portion extending from one of two sides of the base portion. The tongue portion has a first surface (i.e., upper surface) and a second surface (i.e., lower surface) opposite to the first surface. The first receptacle terminals comprise a plurality of first signal terminals, at least one power terminal, and at least one ground terminal. Each of the first receptacle terminals is held in the insulated housing and disposed at the first surface. Each of the first receptacle terminals comprises a flat contact portion, a body portion, and a tail portion. The body portion is held in the base portion and disposed at the first surface of the tongue portion. The flat contact portion is extending forward from the body portion in the rear-to-front direction and partly exposed upon the first surface of the tongue portion. The tail portion is extending backward from the body portion in the front-to-rear direction and extending out of the base portion. The tail portion of the ground terminal of the first receptacle terminals is substantially perpendicularly extending from the body portion and extending out of the base portion. The second receptacle terminals comprise a plurality of second signal terminals, at least one power terminal, and at least one ground terminal. Each of the second receptacle terminals is held in the insulated housing and disposed at the second surface. Each of the second receptacle terminals comprises a flat contact portion, a body portion, and a tail portion. The body is held in the base portion and disposed at the second surface of the tongue portion. The flat contact portion is extending forward from the body portion in the rear-to-front direction and partly exposed upon the second surface of the tongue portion. The tail portion is extending backward from the body portion in the front-to-rear direction and extending out of the base portion. The tail portion of the ground terminal of the second receptacle terminal is substantially perpendicularly extending from the body portion and extending out of the base portion, and the tail portion of the ground terminal of the second receptacle terminals is adjacent to and combined with the tail portion of the ground terminal of the first receptacle terminals.

In one embodiment, one surface of the tail portion of the ground terminal of the second receptacle terminals is in contact with one surface of the tail portion of the ground terminal of the first receptacle terminals.

In one embodiment, one surface of the tail portion of the ground terminal of the second receptacle terminals is spaced from one surface of the tail portion of the ground terminal of the first receptacle terminals by a gap.

In one embodiment, the electrical receptacle connector further comprises a circuit board. The circuit board comprises a plurality of first soldering holes and a plurality of second soldering holes. Except the tail portion of the ground terminal of the first receptacle terminals and except the tail portion of the ground terminal of the second receptacle terminals, rest of the tail portions of the first receptacle terminals and the tail portions of the second receptacle terminals are inserted into the first soldering holes. The tail portion of the ground terminal of the first receptacle terminals and the tail portion of the ground terminal of the second receptacle terminals are inserted into the second soldering holes. The diameter of each of the first soldering holes is less than the diameter of each of the second soldering holes.

In one embodiment, the electrical receptacle connector further comprises a grounding plate at the insulated housing. The grounding plate comprises a plate body and a plurality of legs, the plate body is between the flat contact portions of the first receptacle terminals and the flat contact portions of the second receptacle terminals. The legs are extending outward from two sides of the plate body and extending out of the insulated housing. In addition, each of the legs of the grounding plate is adjacent to and combined with at least one of the tail portion of the ground terminal of the first receptacle terminals and the tail portion of the ground terminal of the second receptacle terminals.

In one embodiment, the first receptacle terminals and the second receptacle terminals have 180 degree symmetrical design with respect to a central point of the receptacle cavity as the symmetrical center.

In one embodiment, the position of the flat contact portions of the first receptacle terminals corresponds to the position of the flat contact portions of the second receptacle terminals.

Yet an embodiment of the instant disclosure provides an electrical receptacle connector. The electrical receptacle connector comprises a metallic shell, an insulated housing, a plurality of first receptacle terminals, and a plurality of second receptacle terminals. The metallic shell comprises a shell body and a receptacle cavity formed in the shell body. The insulated housing is received in the receptacle cavity. The insulated housing comprises a base portion and a tongue portion extending from one of two sides of the base portion. The tongue portion has a first surface (i.e., upper surface) and a second surface (i.e., lower surface) opposite to the first surface. The first receptacle terminals comprise a plurality of first signal terminals, at least one power terminal, and at least one ground terminal. Each of the first receptacle terminals is held in the insulated housing and disposed at the first surface. Each of the first receptacle terminals comprises a flat contact portion, a body portion, and a tail portion. The body portion is held in the base portion and disposed at the first surface of the tongue portion. The flat contact portion is extending forward from the body portion in the rear-to-front direction and partly exposed upon the first surface of the tongue portion. The tail portion is extending backward from the body portion in the front-to-rear direction and extending out of the base portion. The tail portion of the power terminal of the first receptacle terminals is substantially perpendicularly extending from the body portion and extending out of the base portion, and the tail portion of the ground terminal of the first receptacle terminals is substantially perpendicularly extending from the body portion and extending out of the base portion. The second receptacle terminals comprise a plurality of second signal terminals, at least one power terminal, and at least one ground terminal. Each of the second receptacle terminals is held in the insulated housing and disposed at the second surface. Each of the second receptacle terminals comprises a flat contact portion, a body portion, and a tail portion. The body is held in the base portion and disposed at the second surface of the tongue portion. The flat contact portion is extending forward from the body portion in the rear-to-front direction and partly exposed upon the second surface of the tongue portion. The tail portion is extending backward from the body portion in the front-to-rear direction and extending out of the base portion. The tail portion of the power terminal of the second receptacle terminals is substantially perpendicularly extending from the body portion and extending out of the base portion, and the tail portion of the power terminal of the second receptacle terminals is adjacent to and combined with the tail portion of the power terminal of the first receptacle terminals. The tail portion of the ground terminal of the second receptacle terminal is substantially perpendicularly extending from the body portion and extending out of the base portion, and the tail portion of the ground terminal of the second receptacle terminals is adjacent to and combined with the tail portion of the ground terminal of the first receptacle terminals.

Based on the above, the tail portion of the power terminal of the first receptacle terminals and the tail portion of the power terminal of the second receptacle terminals are adjacent to and combined with each other, the tail portion of the power terminal of the first receptacle terminals and the tail portion of the power terminal of the second receptacle terminals are inserted into the same second soldering hole. Consequently, the cost and time for the soldering procedure of the connector manufacturing can be reduced. Alternatively, the tail portion of the ground terminal of the first receptacle terminals and the tail portion of the ground terminal of the second receptacle terminals are adjacent to and combined with each other, the tail portion of the ground terminal of the first receptacle terminals and the tail portion of the ground terminal of the second receptacle terminals are inserted into the same second soldering hole. Consequently, the cost and time for the soldering procedure of the connector manufacturing can be reduced. In a further option, the tail portion of the power terminal of the first receptacle terminals and the tail portion of the power terminal of the second receptacle terminals are adjacent to and combined with each other, the tail portion of the ground terminal of the first receptacle terminals and the tail portion of the ground terminal of the second receptacle terminals are adjacent to and combined with each other, and the four pins are inserted into the same second soldering hole. Consequently, the cost and time for the soldering procedure of the connector manufacturing can be further reduced.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 15 illustrates a schematic configuration diagram of the receptacle terminals of the electrical receptacle connector of the third embodiment.

DETAILED DESCRIPTION

Figure 1:
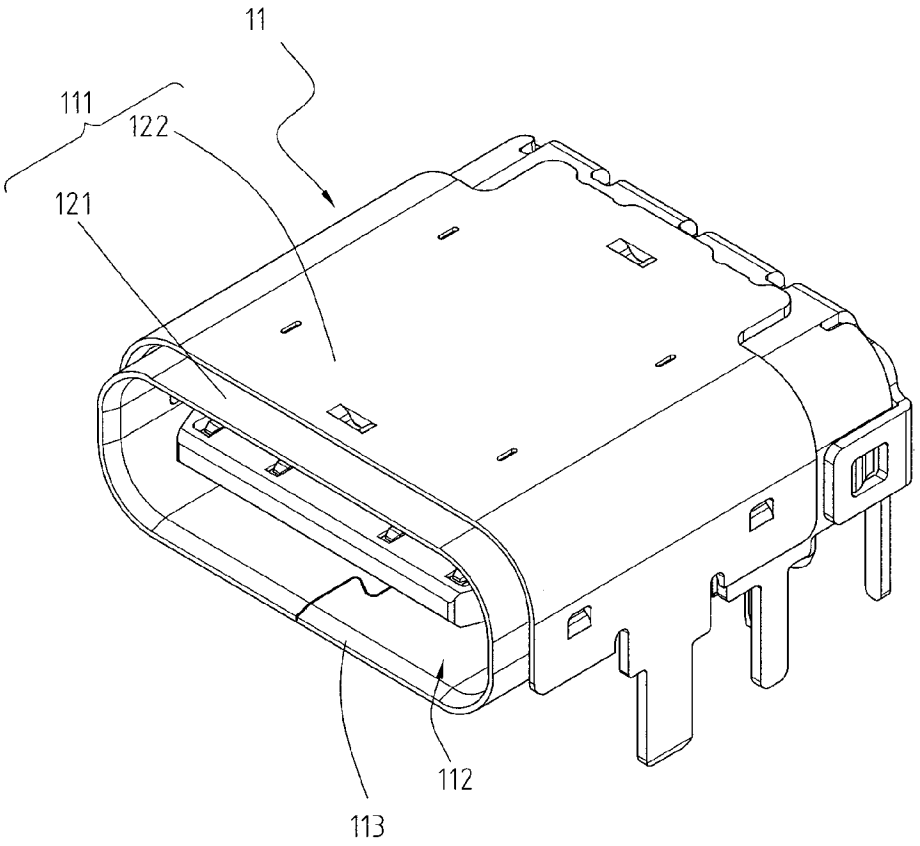
FIG. 1 illustrates a perspective view of an electrical receptacle connector according to a first embodiment of the instant disclosure.
Figure 2:
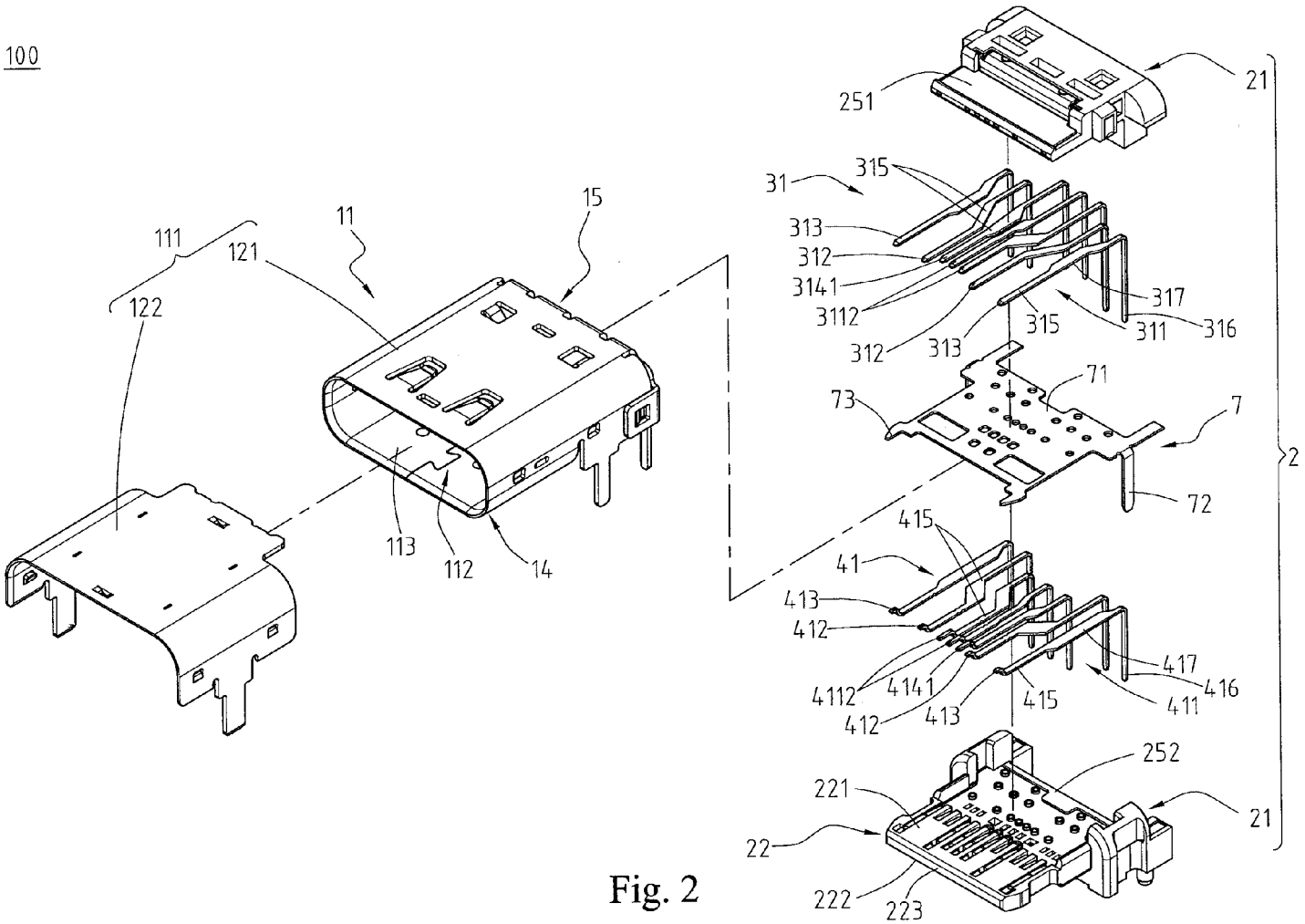
FIG. 2 illustrates an exploded view of the electrical receptacle connector of the first embodiment.
Figure 3:
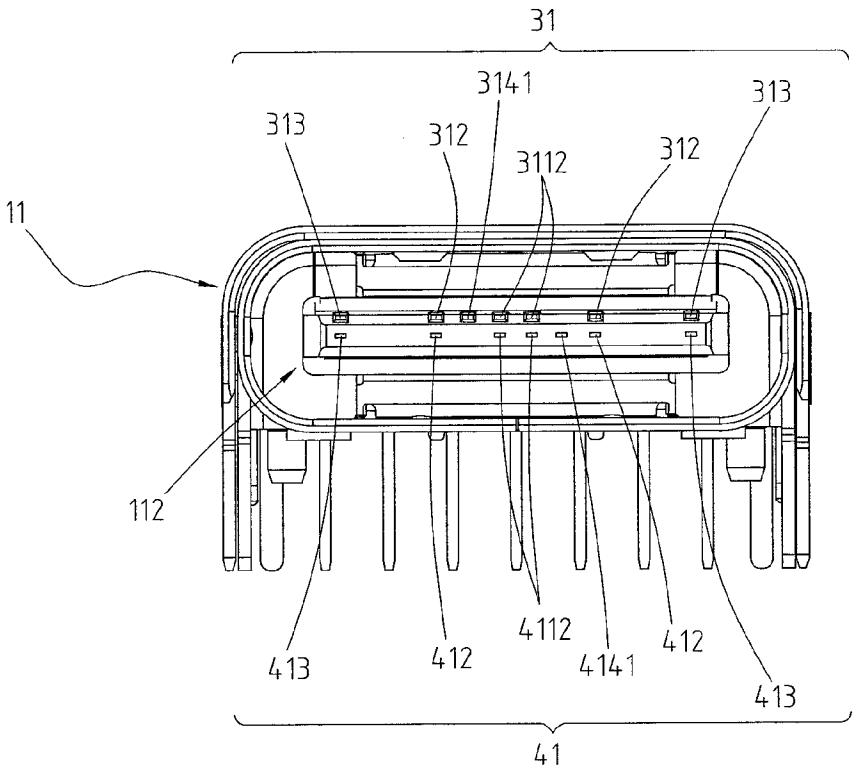
FIG. 3 illustrates a front sectional view of the electrical receptacle connector of the first embodiment.
Figure 4:
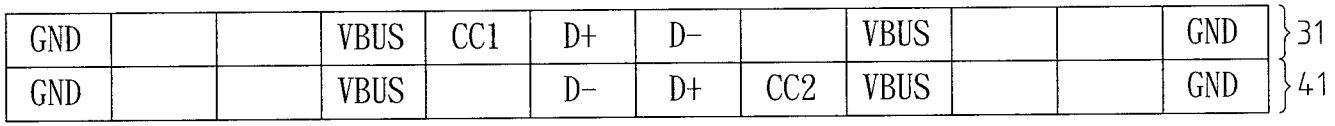
FIG. 4 illustrates a schematic configuration diagram of the receptacle terminals of the electrical receptacle connector shown in FIG. 3.

Please refer to FIGS. 1 to 4, which illustrate an electrical receptacle connector 100 of a first embodiment of the instant disclosure. FIG. 1 illustrates a perspective view of an electrical receptacle connector 100. FIG. 2 illustrates an exploded view of the electrical receptacle connector 100. FIG. 3 illustrates a front sectional view of the electrical receptacle connector 100. FIG. 4 illustrates a schematic configuration diagram of the receptacle terminals of the electrical receptacle connector 100 shown in FIG. 3. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, an insulated housing 2, a plurality of first receptacle terminals 31, and a plurality of second receptacle terminals 41.

The metallic shell 11 is a hollowed shell, and the metallic shell 11 comprises a shell body 111 and a receptacle cavity 112 formed in the shell body 111. In this embodiment, the shell body 111 is a tubular structure and defines the receptacle cavity 112 therein. While in some embodiments, the metallic shell 11 may be formed by a multi-piece member; in such embodiments, the shell body 111 further comprises an inner shell 121 and a case 122. The inner shell 121 is a tubular structure 14 circularly enclosing the insulated housing 21. The case 122 may be a tubular structure 14 circularly enclosing the inner shell 121, but embodiments are not limited thereto. Alternatively, the case 122 may be a semi-tubular structure having a U-shaped cross section, and the case 122 can be covered on the top and two sides of the inner shell 121 and provided as an outer shell structure of the inner shell 121. In this embodiment, a rear cover plate 15 is extending from the rear of the case 122, and the rear cover plate 15 is openable and closeable. In one embodiment, the rear cover plate 15 is at the rear of the inner shell 121 and the shell body 111 does not comprise the case 122. In addition, an inserting opening 113 with oblong shaped is formed at one side of the metallic shell 11, and the inserting opening 113 communicates with the receptacle cavity 112.

The insulated housing 2 is received in the receptacle cavity 112 of the metallic shell 11. The insulated housing 2 comprises a base portion 21 and a tongue portion 22. In this embodiment, the insulated housing 2 further comprises a first portion 251 and a second portion 252. The first portion 251 and the second portion 252 are assembled with each other. After the first portion 251 and the second portion 252 are assembled with each other, the assembly of the first portion 251 and the second portion 252 forms the base portion 21 and the tongue portion 22. The base portion 21 and the tongue portion 22 may be made by injection molding or the like to form the insulated housing 2, so that the base portion 21 and the tongue portion 22 are produced integrally as a whole. In addition, a grounding plate 7 is formed in the base portion 21 and the tongue portion 22. Moreover, the tongue portion 22 is extending from one of two sides of the base portion 21. The tongue portion 22 is in the front of the receptacle cavity 112, while the base portion 21 is in the rear of the receptacle cavity 112. In addition, the tongue portion 22 has two opposite surfaces, one is a first surface 221 (i.e., the upper surface), and the other is a second surface 222 (i.e., the lower surface). In addition, the front lateral surface 223 of the tongue portion 22 is connected the first surface 221 with the second surface 222 and is close to the insertion opening 113. In other words, the front lateral surface 223 is adjacent to the insertion opening 113 and perpendicularly connected to the first surface 221 and the second surface 222, respectively.

The first receptacle terminals 31 comprise a plurality of first signal terminals 311, at least one power terminal 312, and at least one ground terminal 313. The first signal terminals 31 comprise a pair of first low-speed signal terminals 3112. Referring to FIG. 4, the first receptacle terminals 31 comprise, from left to right, a ground terminal 313 (Gnd), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), another power terminal 312 (Power/VBUS), and another ground terminal 313 (Gnd). In this embodiment, seven first receptacle terminals 31 are provided for transmitting USB 2.0 signals. The pair of the first low-speed signal terminals 3112 is between the first function detection terminal 3141 and the power terminal 312.

The first receptacle terminals 31 are held in the base portion 21 and the tongue portion 22 and formed as the upper-row terminals of the electrical receptacle connector 100. In other words, the first receptacle terminals 31 are assembled to the first portion 251. Each of the first receptacle terminals 31 comprises a flat contact portion 315, a body portion 317, and a tail portion 316. For convenience, the term "tail portion 316" is the same as the term "first tail portion 316". For each of the first receptacle terminals 31, the body portion 317 is held in the base portion 21 and the tongue portion 22, the flat contact portion 315 is extending forward from the body portion 317 in the rear-to-front direction and partly exposed upon the first surface 221 of the tongue portion 22, and the tail portion 316 is extending backward from the body portion 317 in the front-to-rear direction and protruding from the base portion 21. The first signal terminals 311 are disposed at the first surface 221 and transmit first signals (namely, USB 2.0 signals). The tail portions 316 are protruding from the bottom of the base portion 21. In addition, the tail portions 316 are substantially perpendicularly extending from the body portions 317 and extending downwardly to form vertical legs, named through-hole legs, that are inserted into holes drilled in a printed circuit board by using through-hole technology, as shown in FIGS. 6 to 9.

The second receptacle terminals 41 comprise a plurality of second signal terminals 411, at least one power terminal 412, and at least one ground terminal 413. The second receptacle terminals 41 comprise a pair of second low-speed signal terminals 4112. Referring to FIG. 4, the second receptacle terminals 41 comprise, from right to left, a ground terminal 413 (Gnd), a power terminal 412 (Power/VBUS), a second function detection terminal 4141 (CC2, a terminal for inserting orientation detection of the connector and for cable recognition), a pair of second low-speed signal terminals 4112 (D+−, differential signal terminals for low-speed signal transmission), another power terminals 412 (Power/VBUS), and another ground terminal 413 (Gnd). In this embodiment, seven second receptacle terminals 41 are provided for transmitting USB 2.0 signals. The pair of the second low-speed signal terminals 4112 is between the second function detection terminal 4141 and the power terminal 412.

The second receptacle terminals 41 are held in the base portion 21 and the tongue portion 22 and formed as the lower-row terminals of the electrical receptacle connector 100. In other words, the second receptacle terminals 41 are assembled to the second portion 252. The length of each of the first receptacle terminals 31 is greater than that of the corresponding second receptacle terminal 41; that is, the exposed length of each of the first receptacle terminals 31 is greater than that of the corresponding second receptacle terminal 41. Each of the second receptacle terminals 41 comprises a flat contact portion 415, a body portion 417, and a tail portion 416. For convenience, the term "tail portion 416" is the same as the term "second tail portion 416". For each of the second receptacle terminals 41, the body portion 417 is held in the base portion 21 and the tongue portion 22, the flat contact portion 415 is extending from the body portion 417 in the rear-to-front direction and partly exposed upon the second surface 222 of the tongue portion 22, and the tail portion 416 is extending backward from the body portion 417 in the front-to-rear direction and protruding from the base portion 21. The second signal terminals 411 are disposed at the second surface 222 and provided for transmitting second signals (i.e., USB 2.0 signals). The tail portions 416 are protruding from the bottom of the base portion 21. In addition, the tail portions 416 are substantially perpendicularly extending from the body portions 417 and extending downwardly to form vertical legs, named through-hole legs, that are inserted into holes drilled in a printed circuit board by using through-hole technology, as shown in FIGS. 6 to 9.

Please refer to FIGS. 5, 6, 8, and 9. In this embodiment, the electrical receptacle connector 100 further comprises a circuit board 5. The circuit board 5 comprises a plurality of first soldering holes 51 and a plurality of second soldering holes 52'/52". The first soldering holes 51 and the second soldering holes 52'/52" are respectively formed on the circuit board 5. The diameter of each of the first soldering holes 51 is less than the diameter of each of the second soldering holes 52'/52". In other words, the diameter of the first soldering hole 51 allows one tail portion 316/416 passing therethrough, while the diameter of the second soldering hole 52'/52" allows two or more combined tail portions passing therethrough.

Please refer to FIGS. 2, 5, 8, and 9. In this embodiment, the first tail portion 316 of the power terminal 312 and the second tail portion 416 of the power terminal 412 are adjacent to and combined with each other, and the combined tail portion is inserted into a single second soldering hole 52'. In addition, the first tail portion 316 of the ground terminal 313 and the second tail portion 416 of the ground terminal 413 are adjacent to and combined with each other, and the combined tail portion is inserted into another single second soldering hole 52", but embodiments are not limited thereto. In some embodiments, only the first tail portion 316 of the power terminal 312 and the second tail portion 416 of the power terminal 412 are adjacent to and combined with each other for inserting into one single second soldering hole 52'; conversely, the first tail portion 316 of the ground terminal 313 and the second tail portion 416 of the ground terminal 413 are neither adjacent to nor combined with each other, and the first tail portion 316 of the ground terminal 313 and the second tail portion 416 of the ground terminal 413 are respectively inserted into separated first soldering holes 51. Alternatively, only the first tail portion 316 of the ground terminal 313 and the second tail portion 416 of the ground terminal 413 are adjacent to and combined with each other for inserting into one single second soldering hole 52"; conversely, the first tail portion 316 of the power terminal 312 and the second tail portion 416 of the power terminal 412 are neither adjacent to nor combined with each other, and the first tail portion 316 of the power terminal 312 and the second tail portion 416 of the power terminal 412 are respectively inserted into separated first soldering holes 51.

Figure 5:
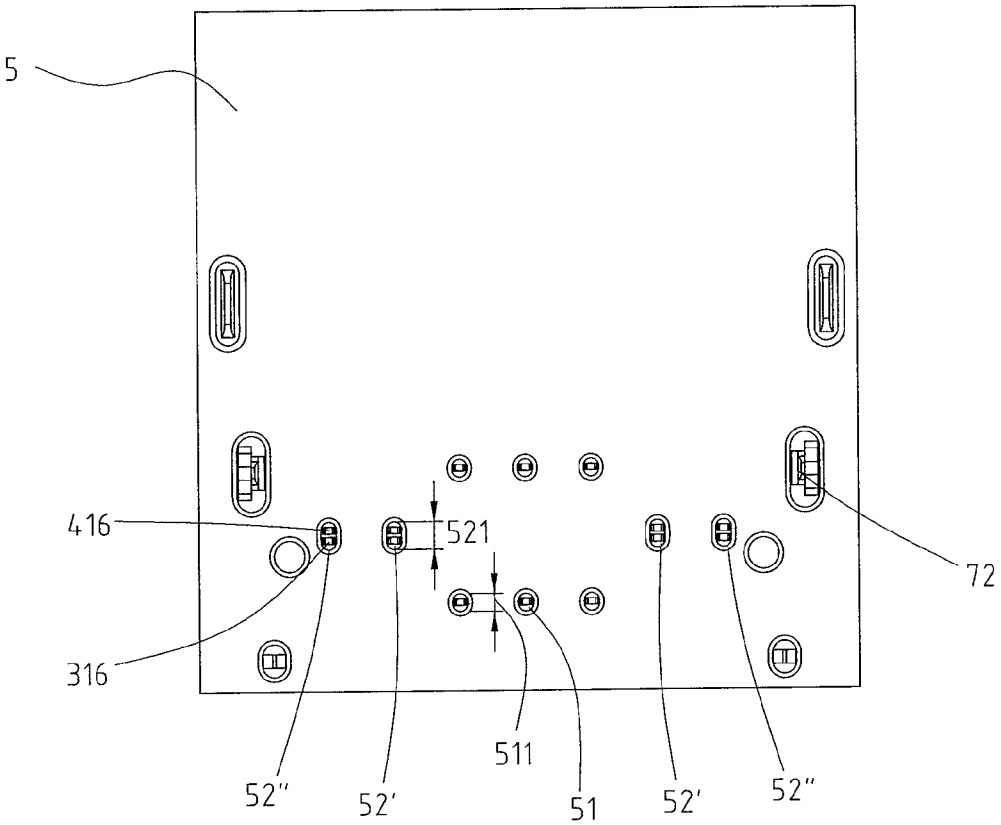
FIG. 5 is a top view showing the assembly of a circuit board and the electrical receptacle connector of the first embodiment.
Figure 8:
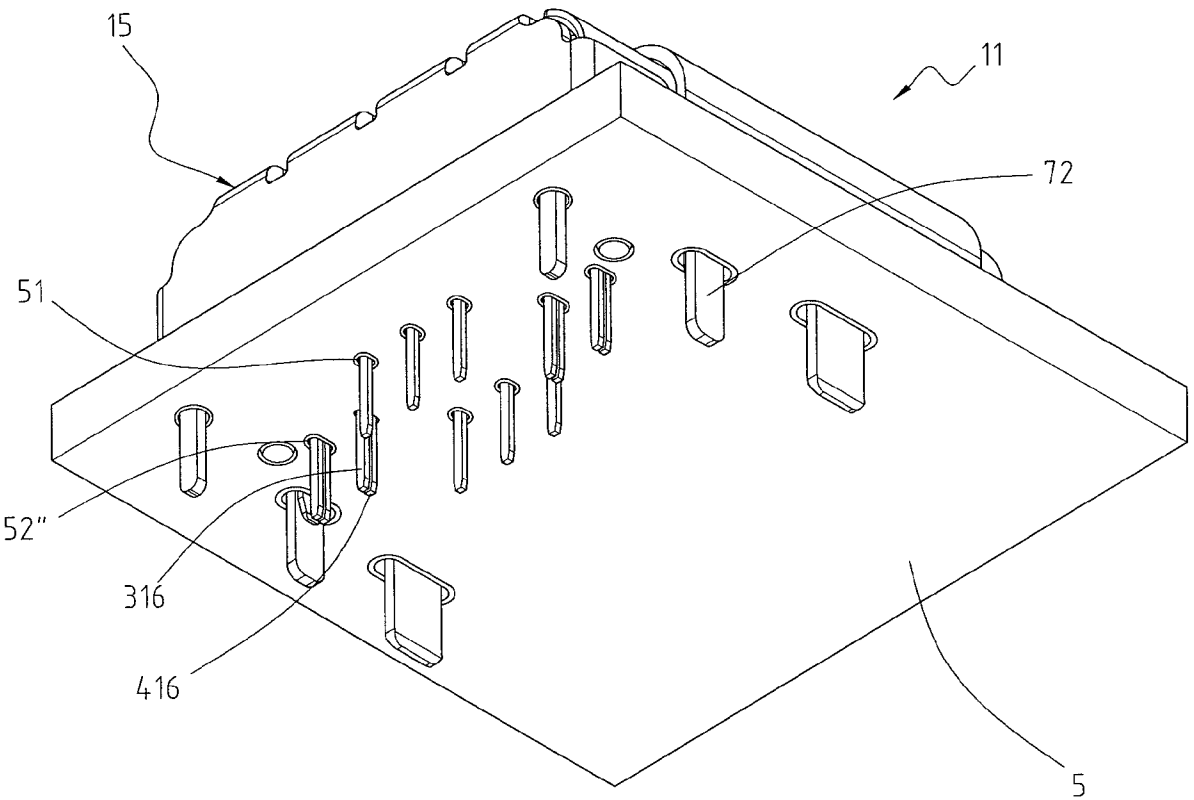
FIG. 8 illustrates a perspective view of an assembly of the circuit board and the electrical receptacle connector of the first embodiment.

Please refer to FIGS. 2, 5, and 8. Except the first tail portion 316 of the power terminal 312 and the second tail portion 416 of the power terminal 412, rest of the tail portions 316 of the first receptacle terminals 41 and the tail portions 416 of the second receptacle terminals 41 are inserted into the first soldering holes 51. In other words, the tail portion 316 of the ground terminal 313, the tail portion 316 of the function detection terminal CC1, the tail portions 316 of the pair of first low-speed signal terminals 3112 of the first receptacle terminals 31 and the tail portion 416 of the ground terminal 413, the tail portion 416 of the function detection terminal CC2, the tail portions 416 of the pair of second low-speed signal terminals 4112 of the second receptacle terminals 41 are inserted into the first soldering holes 51. Neither the first tail portion 316 of the power terminal 312 nor the second tail portion 416 of the power terminal 412 is inserted into the first soldering holes 51.

Please refer to FIGS. 2, 5, 8, and 9. Because the first tail portion 316 of the power terminal 312 and the second tail portion 416 of the power terminal 412 are adjacent to and combined with each other, the first tail portion 316 of the power terminal 312 and the second tail portion 416 of the power terminal 412 are inserted into the second soldering hole 52' when the circuit board 5 is assembled with the receptacle terminals 31, 41. The diameter 521 of the second soldering hole 52' is greater than the width of the combined tail portion of the power terminal 312 of the first receptacle terminals 31 and the power terminal 412 of the second receptacle terminals 41. In other words, the two tail portions (the first tail portion 316 of the power terminal 312 and the second tail portion 416 of the power terminal 412) are inserted into the same second soldering hole 52'. Accordingly, the number of the soldering holes on the circuit board 5 can be reduced. Consequently, the cost and time for the soldering procedure of the connector manufacturing can be reduced.

Please refer to FIGS. 2, 5, 8, and 9. Because the first tail portion 316 of the ground terminal 313 and the second tail portion 416 of the ground terminal 413 are adjacent to and combined with each other, the first tail portion 316 of the ground terminal 313 and the second tail portion 416 of the ground terminal 413 are inserted into the second soldering hole 52" when the circuit board 5 is assembled with the receptacle terminals 31, 41. The diameter 521 of the second soldering hole 52" is greater than the width of the combined tail portion of the ground terminal 313 of the first receptacle terminals 31 and the ground terminal 413 of the second receptacle terminals 41. In other words, the two tail portions (the first tail portion 316 of the ground terminal 313 and the second tail portion 416 of the ground terminal 413) are inserted into the same second soldering hole 52". Accordingly, the number of the soldering holes on the circuit board 5 can be reduced. Consequently, cost and time for the soldering procedure of the connector manufacturing can be reduced.

Figure 7:
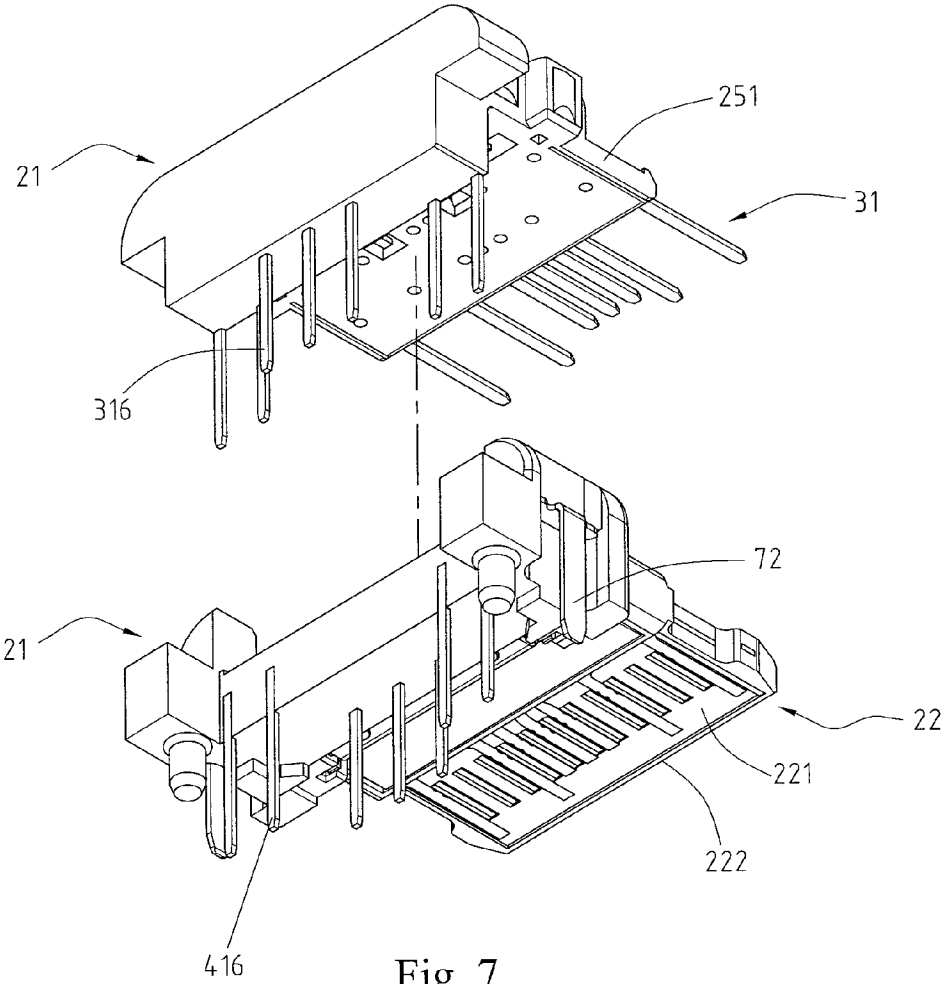
FIG. 7 illustrates a partial exploded view of the electrical receptacle connector of the first embodiment.

Please refer to FIGS. 2, 7, and 8. In this embodiment, the first tail portion 316 of the power terminal 312 is substantially perpendicularly extending from the body portion 317 and extending out of the base portion 21, and the second tail portion 416 of the power terminal 412 is substantially perpendicularly extending from the body portion 417 and extending out of the base portion 21. The second tail portion 416 of the power terminal 412 is adjacent to and combined with the first tail portion 316 of the power terminal 312. In other words, the first tail portion 316 of the power terminal 312 and the second tail portion 416 of the power terminal 412 are combined and aligned together, and the alignment of the combined tail portions is not limited. For example, the combined tail portions may be aligned in the second soldering hole 52'/52" along the transversal direction (as shown in FIG. 10C), along the longitudinal direction (as shown in FIG. 10B), or along an oblique direction (as shown in FIG. 10D). In addition, the first tail portion 316 of the ground terminal 313 is substantially perpendicularly extending from the body portion 317 and extending out of the base portion 21, and the second tail portion 416 of the ground terminal 413 is substantially perpendicularly extending from the body portion 417 and extending out of the base portion 21. The second tail portion 416 of the ground terminal 413 is adjacent to and combined with the first tail portion 316 of the ground terminal 313. In other words, the first tail portion 316 of the ground terminal 313 and the second tail portion 416 of the ground terminal 413 are combined and aligned together, and the alignment of the combined tail portions is not limited. For example, the combined tail portions may be aligned in the second soldering hole 52'/52" along the transversal direction (as shown in FIG. 10C), along the longitudinal direction (as shown in FIG. 10B), or along an oblique direction (as shown in FIG. 10D).

Figure 9:
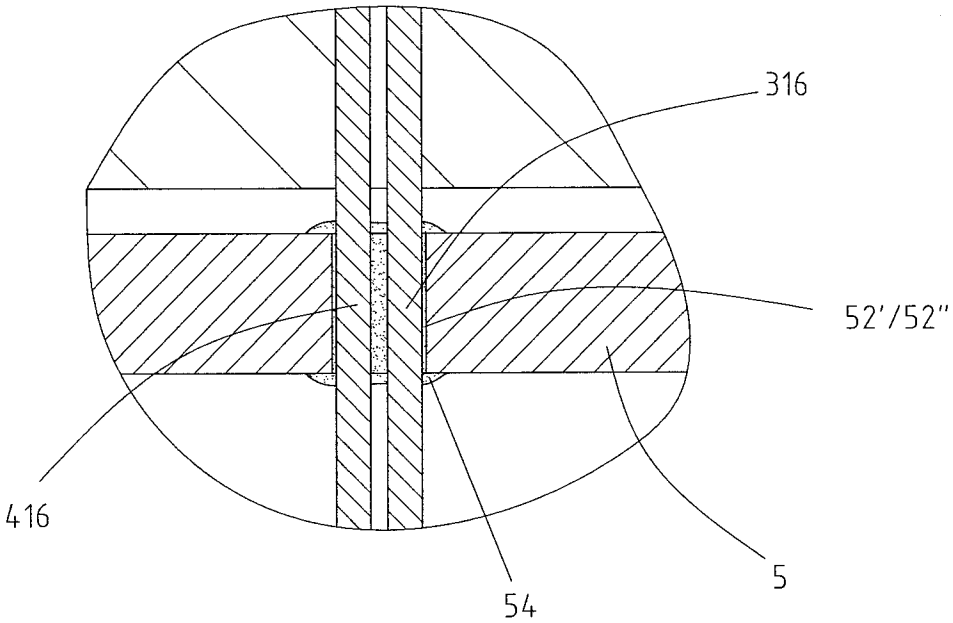
FIG. 9 illustrates an enlarged sectional schematic view showing that tail portions of receptacle terminals are combined with each other and inserted into the same soldering hole, according to the first embodiment.
Figure 10A:
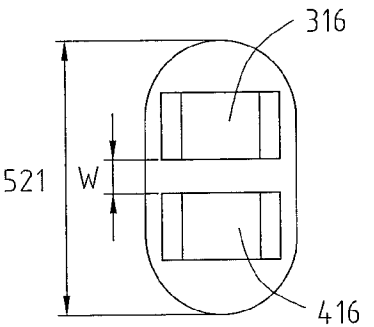
FIG. 10A illustrates an enlarged schematic view (1) showing that tail portions of receptacle terminals are combined with each other and inserted into the same soldering hole.
Figure 10B:
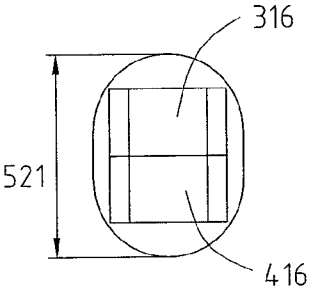
FIG. 10B illustrates an enlarged schematic view (2) showing that tail portions of receptacle terminals are combined with each other and inserted into the same soldering hole.
Figure 10C:
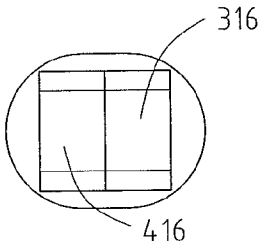
FIG. 10C illustrates an enlarged schematic view (1) showing that tail portions of receptacle terminals are aligned with each other and inserted into the same soldering hole.
Figure 10D:
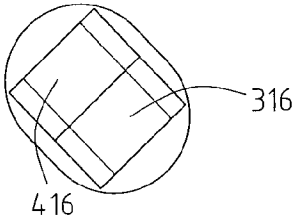
FIG. 10D illustrates an enlarged schematic view (2) showing that tail portions of receptacle terminals are aligned with each other and inserted into the same soldering hole.

Please refer to FIGS. 2, 9, and 10A. In this embodiment, a gap W is formed between the first tail portion 316 of the power terminal 312 and the second tail portion 416 of the power terminal 412. In other words, one surface of the second tail portion 416 of the power terminal 412 is spaced from one surface of the first tail portion 316 of the power terminal 312 by the gap W. Under this arrangement, the diameter 521 of the second soldering hole 52' of the circuit board 5 is designed to allow the insertion of the first tail portion 316 of the power terminal 312 and the second tail portion 416 of the power terminal 412. In addition, the gap W is formed between the first tail portion 316 of the power terminal 312 and the second tail portion 416 of the power terminal 412, and solders 54 are applied on the first tail portion 316 of the power terminal 312, the second tail portion 416 of the power terminal 412, and the gap W. Moreover, another gap W is formed between the first tail portion 316 of the ground terminal 313 and the second tail portion 416 of the ground terminal 413, and solders 54 are applied on the first tail portion 316 of the ground terminal 313, the second tail portion 416 of the ground terminal 413, and the gap W.

It is understood that, in some embodiments, the tail portions 316, 416 may be spaced from each other by the gap W, but embodiments are not limited thereto. In one embodiment, the first tail portion 316 of the power terminal 312 and the second tail portion 416 of the power terminal 412 are attached together, as shown in FIG. 10B. In addition, the first tail portion 316 of the ground terminal 313 and the second tail portion 416 of the ground terminal 413 may be attached together. That is, one surface of the second tail portion 416 of the power terminal 412 is in contact with one surface of the first tail portion 316 of the power terminal 312, and one surface of the second tail portion 416 of the ground terminal 413 is in contact with one surface of the first tail portion 316 of the ground terminal 313. In this embodiment, because the first tail portion 316 of the power terminal 312 and the second tail portion 416 of the power terminal 412 are attached together, the diameter 521 of the second soldering hole 52'/52" for the insertion of the combined tail portions can be reduced as compared to the diameter 521 of a second soldering hole 52'/52" for the insertion of uncombined tail portions. That is, when the gap W is formed between the tail portions 316, 416, the diameter 521 of the second soldering hole 52'/52" is rather larger for the insertion of the tail portions 316, 416; while when the tail portions 316, 416 are attached together, the diameter 521 of the second soldering hole 52'/52" is rather smaller for the insertion of the tail portions 316, 416. Consequently, when the tail portions 316, 416 are attached together, the diameter 521 of the second soldering hole 52'/52" can be reduced, and the saved space on the circuit board 5 can be utilized for layout or wiring.

In this embodiment, the cross section of the tail portion 316 along the length direction of the first receptacle terminal 31 is a rectangle, but embodiments are not limited thereto. Alternatively, the cross section of the tail portion 316 along the length direction of the first receptacle terminal 31 may be a circle or other geometric shapes. Likely, the cross section of the tail portion 416 along the length direction of the second receptacle terminal 41 is a rectangle, but embodiments are not limited thereto. Alternatively, the cross section of the tail portion 416 along the length direction of the second receptacle terminal 41 may be a circle or other geometric shapes.

Please refer to FIGS. 2 and 3. In this embodiment, the first receptacle terminals 31 and the second receptacle terminals 41 are held at the first surface 221 and the second surface 222 of the tongue portion 22; which may be, the first receptacle terminals 31 are held at the first surface 221 of the tongue portion 22 and the second receptacle terminals 41 are held at the second surface 222 of the tongue portion 22, or the first receptacle terminals 31 are held at the second surface 222 of the tongue portion 22 and the second receptacle terminals 41 are held at the first surface 221 of the tongue portion 22. Specifically, the second low-speed signal terminals 4112 are spaced from the first low-speed signal terminals 3112 by a uniform interval. Therefore, the signal interference problem between the first low-speed signal terminals 3112 and the second low-speed signal terminals 4112 can be prevented and improved.

Please refer to FIGS. 2 to 4. Pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180 degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221 is facing up, for transmitting first signals. Conversely, the electrical plug connector is inserted into the electrical receptacle connector 100 with a second orientation where the first surface 221 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Figure 6:
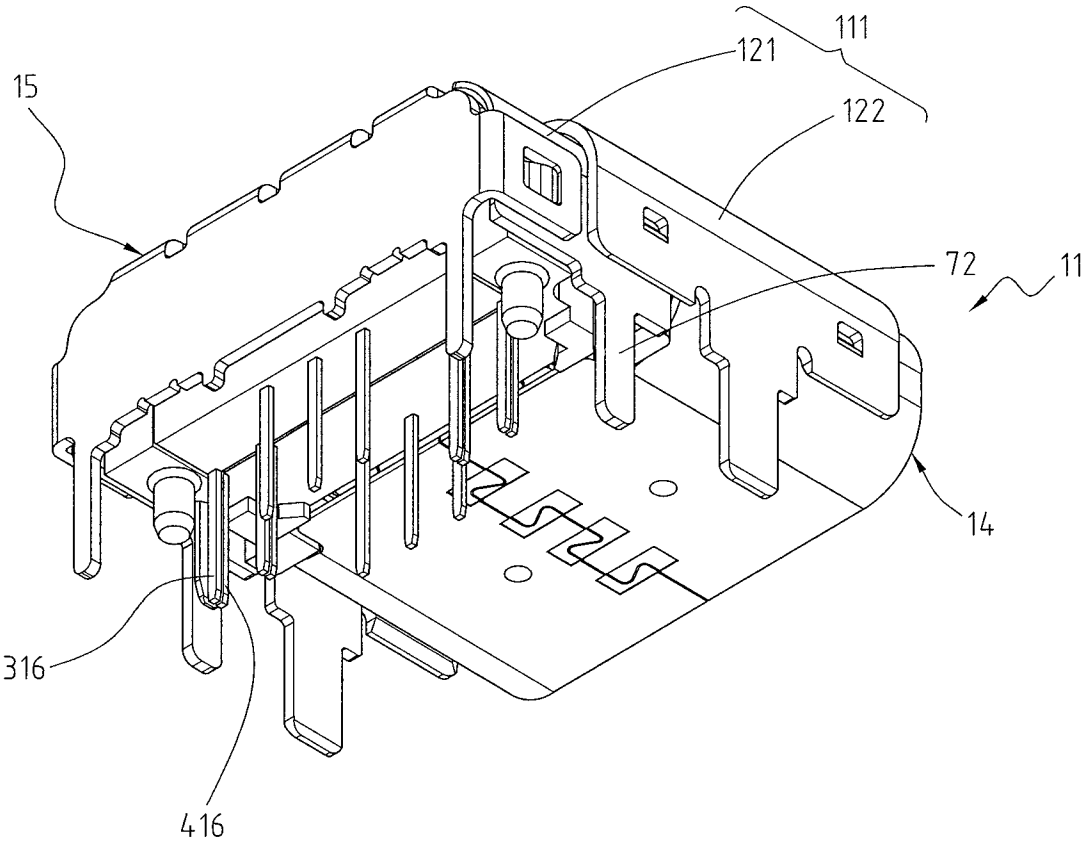
FIG. 6 illustrates another perspective view of the electrical receptacle connector of the first embodiment.

Please refer to FIGS. 6 to 8. In this embodiment, the tail portions 316, 416 are protruding from the base portion 211 and arranged separately. The tail portions 316, 416 may be arranged into three rows, and the first soldering holes 51 and the second soldering holes 52'/52" are arranged into three rows correspondingly. In addition, the first tail portion 316 of the power terminal 312 and the second tail portion 416 of the power terminal 412 may be adjacent to and combined with each other, and the combined tail portions are arranged as a middle row of the receptacle terminals 31, 41, but embodiments are not limited thereto. The first tail portion 316 of the power terminal 312 and the second tail portion 416 of the power terminal 412 may protrude from the base portion 21 from any position. Furthermore, in practice, the tail portions 316, 416 may be aligned into two parallel rows. Alternatively, the tail portions 416 of the second receptacle terminals 41 may be aligned into two rows, and the first row of the tail portions 416 is aligned by an offset with respect to the second row of the tail portions 416; thus, the tail portions 316, 416 form three rows.

Please refer to FIGS. 2 and 3. In this embodiment, as viewed from the front of the receptacle terminals 31, 41, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the receptacle terminals 31, 41, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

Please refer to FIGS. 2 and 7. In this embodiment, the first receptacle terminals 31 are insert-molded with the first portion 251, and the second receptacle terminals 41 are insert-molded with the second portion 252. In addition, the first tail portion 316 of the power terminal 312 is protruding from the front portion of the bottom of the first portion 251, and the second tail portion 416 of the power terminal 412 is protruding from the rear portion of the bottom of the second portion 252. The front lateral surface of the first portion 251 is in contact with and attached to the rear lateral surface of the second portion 252, so the tail portions 316, 416 are adjacent to and combined with each other.

Please refer to FIGS. 2, 6, and 8. In some embodiments, the electrical receptacle connector 100 further comprises a grounding plate 7 at the insulated housing 2. The grounding plate 7 comprises a plate body 71, a plurality of legs 72, and a plurality of hooks 73. The plate body 71 is between the flat contact portions 315 of the first receptacle terminals 31 and the flat contact portions 415 of the second receptacle terminals 41. In other words, the plate body 71 is held in the base portion 21 and the tongue portion 22 and between the flat contact portions 315 and the flat contact portions 415. In addition, the legs 72 are respectively extending downward from two sides of the plate body 71 and extending out of the bottom of the base portion 21. The legs 72 are inserted into the first soldering holes 51 of the circuit board 5. Moreover, the legs 72 may be extending backward from the two sides of the plate body 71 toward the rear of the base portion 21, and the legs 72 are in contact with the rear cover plate 15. The crosstalk interference can be reduced by the shielding of the grounding plate 7 when the flat contact portions 315, 415 transmit signals. Furthermore, the structural strength of the tongue portion 22 can be improved by the assembly of the grounding plate 7. Moreover, the legs 72 extending downward from the two sides of the plate body 71 may be provided as through-hole legs, and the legs 72 are exposed from the base portion 21 to be in contact with the circuit board 5.

Furthermore, as shown in FIG. 2, the hooks 73 are extending from two sides of the front of the plate body 71 and protruding out of the front lateral surface 223 and two sides of the tongue portion 22. When an electrical plug connector is mated with the electrical receptacle connector 100, elastic pieces at two sides of an insulated housing of the electrical plug connector are engaged with the hooks 73, and the elastic pieces would not wear against the tongue portion 22 of the electrical receptacle connector 100. Additionally, the electrical plug connector may further comprise a plurality of protruding abutting portions, and the protruding abutting portions are in contact with the metallic shell 11 of the electrical receptacle connector 100. Hence, the elastic pieces and the protruding abutting portions are provided for conduction and grounding.

Please refer to FIGS. 2 and 3. In this embodiment, the electrical receptacle connector 100 further comprises a plurality of conductive sheets. The conductive sheets are metal elongated plates and may comprise an upper conductive sheet and a lower conductive sheet. The upper conductive sheet is assembled on the upper portion of the base portion 21, and the lower conductive sheet is assembled on the lower portion of the base portion 21. When an electrical plug connector is mated with the electrical receptacle connector 100, the front of a metallic shell of the electrical plug connector is in contact with the conductive sheets, the metallic shell of the electrical plug connector is efficiently in contact with the metallic shell 11 of the electrical receptacle connector 100 via the conductive sheets, and the electromagnetic interference (EMI) problem can be improved.

Figure 11:
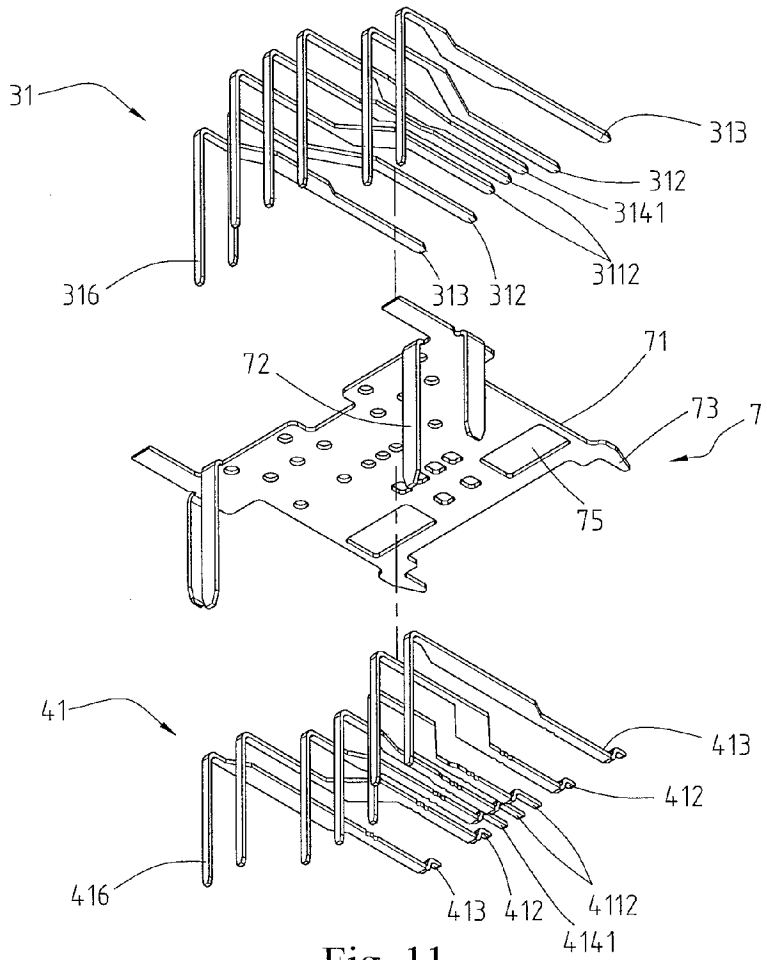
FIG. 11 illustrates an exploded view of a grounding plate with combined legs according to a second embodiment of the instant disclosure.
Figure 12:
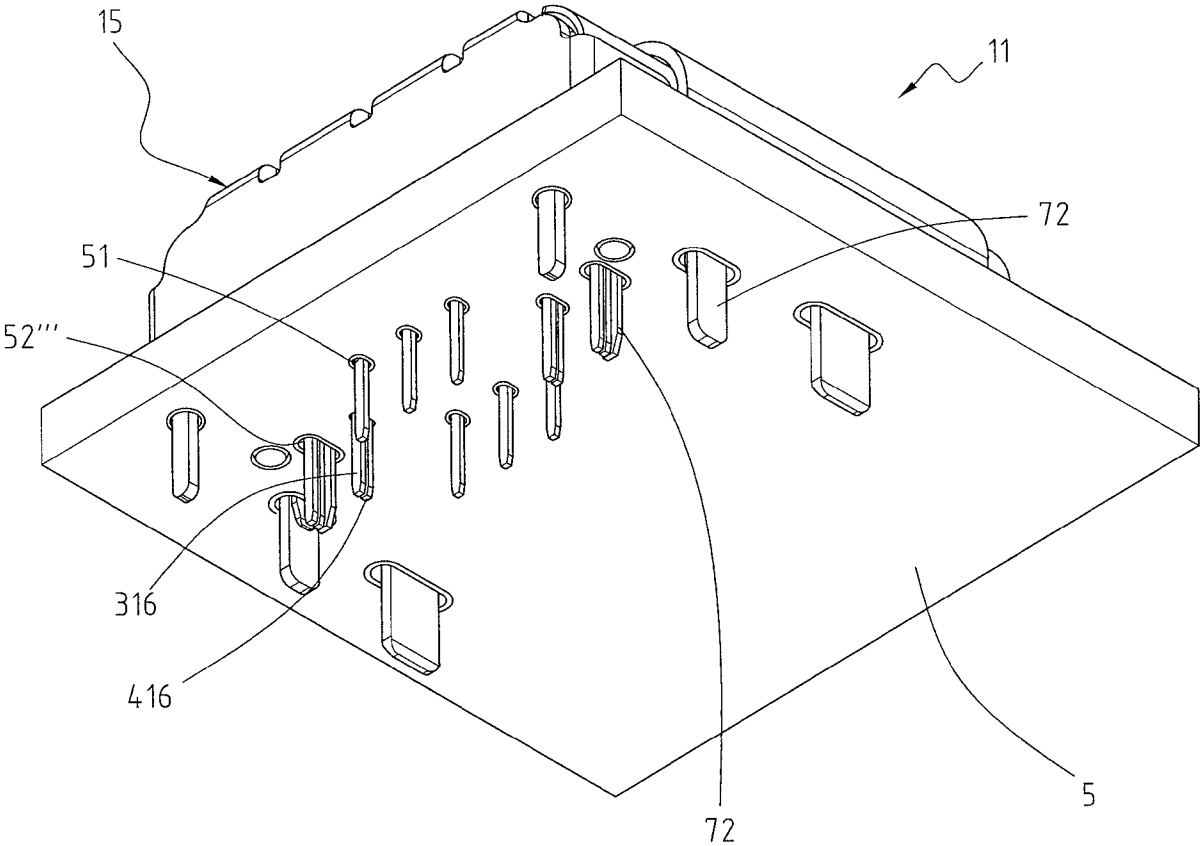
FIG. 12 illustrates a perspective view of an assembly of the circuit board and the electrical receptacle connector of the second embodiment.
Figure 13:
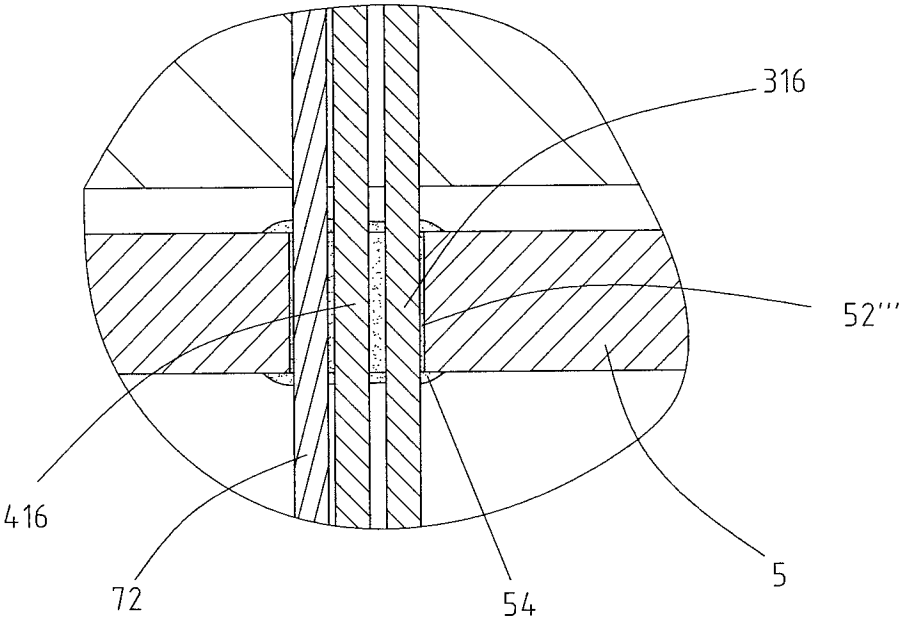
FIG. 13 illustrates an enlarged sectional schematic view showing that tail portions of receptacle terminals are combined with each other and inserted into the same soldering hole, according to the second embodiment.

Please refer to FIGS. 11 to 13, illustrating an electrical receptacle connector 100 according to a second embodiment of the instant disclosure. In the second embodiment, each of the legs 72 of the grounding plate 7 is adjacent to and combined with the first tail portion 316 of the power terminal 312 and the second tail portion 416 of the power terminal 412. In other words, the combined tail portions (the first tail portion 316 of the power terminal 312 and the second tail portion 416 of the power terminal 412) in the first embodiment are further combined with one leg 72 of the grounding plate 7, so that the tail portions 316, 416 and the leg 72 are inserted into a single second soldering hole 52'''.

The diameter 521 of the second soldering hole 52''' in the second embodiment is greater than the diameter 521 of the second soldering hole 52'/52'' in the first embodiment, so that the second soldering hole 52''' in the second embodiment can be provided for the insertion of three pins (two tail portions 316, 416 and one leg 72). Hence, the number of the soldering holes on the circuit board 5 can be further reduced; i.e., the soldering holes for the legs 72 can be omitted. The number of the soldering holes on the circuit board 5 in the second embodiment is less than the number of the soldering holes on the circuit board 5 in the first embodiment. Therefore, the cost and time for the soldering procedure of the connector manufacturing can be further reduced.

Furthermore, in some embodiments, each of the legs 72 of the grounding plate 7 is adjacent to and combined with the first tail portion 316 of the power terminal 312 or the second tail portion 416 of the power terminal 412. In other words, the leg 72 is combined with the first tail portion 316 of the power terminal 312 or the second tail portion 416 of the power terminal 412. Alternatively, the combined tail portions (the first tail portion 316 of the ground terminal 313 and the second tail portion 416 of the ground terminal 413) may be further combined with one leg 72 of the grounding plate 7, so that the tail portions 316, 416 and the leg 72 are inserted into a single second soldering hole 52'''. In a further option, each of the legs 72 of the grounding plate 7 is adjacent to and combined with the first tail portion 316 of the ground terminal 313 or the second tail portion 416 of the ground terminal 413.

Figure 14:
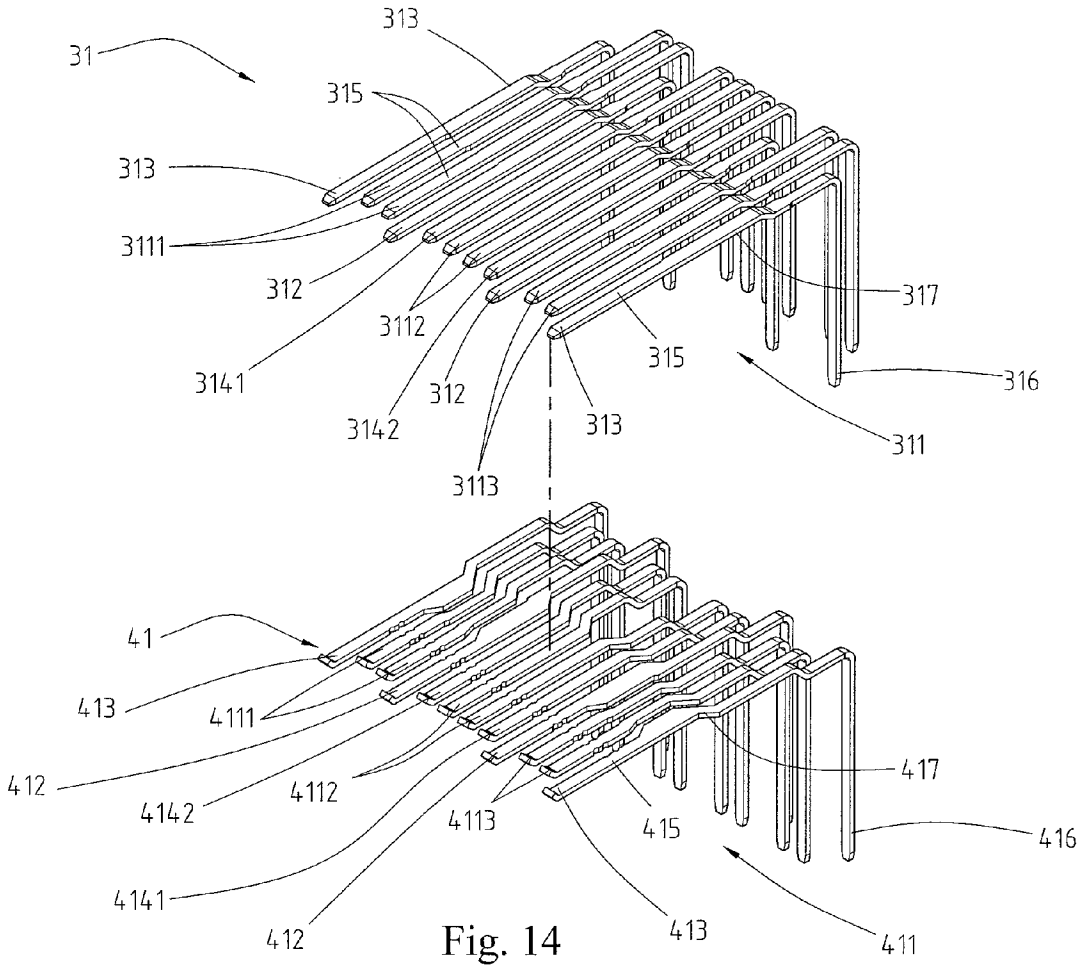
FIG. 14 illustrates an exploded view showing an assembly of first receptacle terminals and second receptacle terminals of an electrical receptacle connector according to a third embodiment of the instant disclosure.
Figure 16:
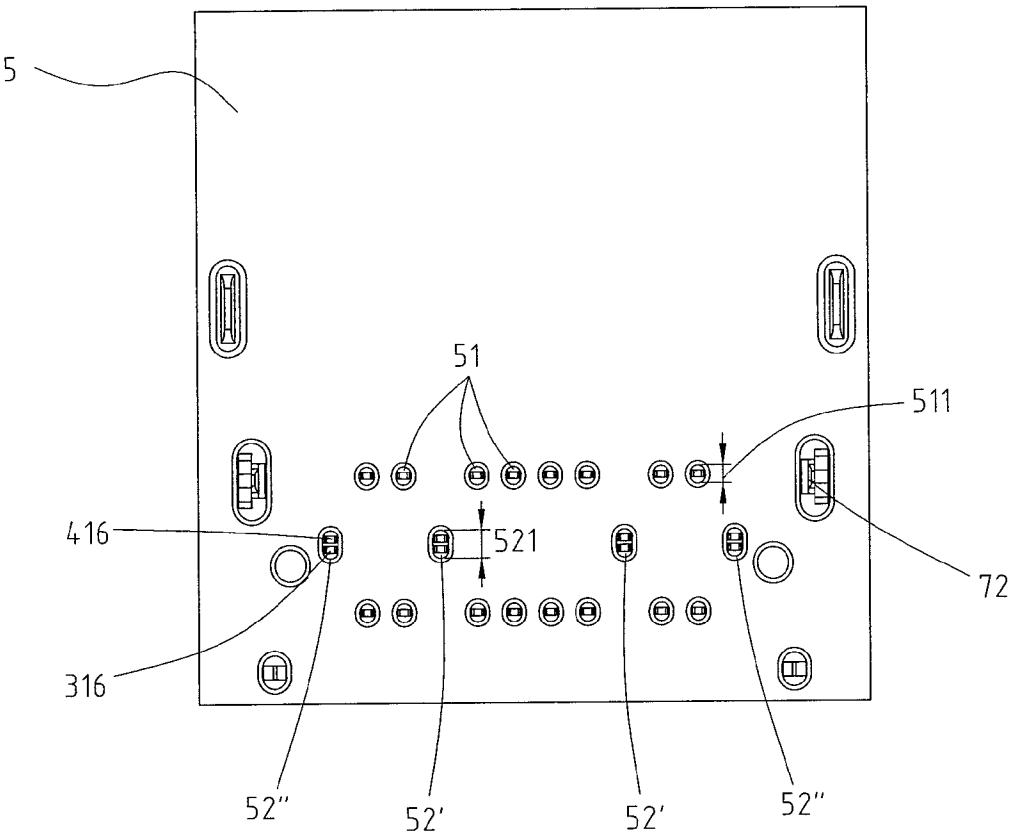
FIG. 16 is a top view showing the assembly of a circuit board and the electrical receptacle connector of the third embodiment.

Please refer to FIGS. 14 to 16, illustrating an electrical receptacle connector 100 according to a third embodiment of the instant disclosure. In the third embodiment, the first receptacle terminals 31 or the second receptacle terminals 41 are provided for transmitting USB 3.0 signals; while in the first embodiment, the first receptacle terminals 31 or the second receptacle terminals 41 are provided for transmitting USB 2.0 signals.

Please refer to FIGS. 14 to 16. The first receptacle terminals 31 comprise a plurality of first signal terminals 311, at least one power terminal 312, and at least one ground terminal 313. The first signal terminals 31 comprises a plurality of pairs of first high-speed signal terminals 3111/3113 and a pair of first low-speed signal terminals 3112. Referring to FIG. 15, the first receptacle terminals 31 comprise, from left to right, a ground terminal 313 (Gnd), a first pair of first high-speed signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), a supplement terminal 3142 (SBU1, a terminal can be reserved for other purposes), another power terminal 312 (Power/VBUS), a second pair of first high-speed signal terminals 3113 (RX2+−, differential signal terminals for high-speed signal transmission), and another ground terminal 313 (Gnd).

Please refer to FIGS. 14 to 16. The second receptacle terminals 41 comprise a plurality of second signal terminals 411, at least one power terminal 412, and at least one ground terminal 413. The second receptacle terminals 41 comprise a plurality of pairs of second high-speed signal terminals 4111/4113 and a pair of second low-speed signal terminals 4112. Referring to FIG. 15, the second receptacle terminals 41 comprise, from right to left, a ground terminal 413 (Gnd), a first pair of second high-speed signal terminals 4111 (TX2+−, differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+−, differential signal terminals for low-speed signal transmission), a supplement terminal 4142 (SBU2, a terminal can be reserved for other purposes), another power terminals 412 (Power/VBUS), a second pair of second high-speed signal terminals 4113 (RX1+−, differential signal terminals for high-speed signal transmission), and another ground terminal 413 (Gnd).

Please refer to FIGS. 14 to 16. In this embodiment, twelve first receptacle terminals 31 and twelve second receptacle terminals 41 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142. Similarly, each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142.

In other words, in the first embodiment, the number of the first receptacle terminals 31 is seven, which is reduced by the twelve terminals of the first receptacle terminals 31 of the third embodiment; similarly, in the first embodiment, the number of the second receptacle terminals 41 is seven, which is reduced by the twelve terminals of the second receptacle terminals 41 of the third embodiment. In some embodiments, for the first receptacle terminals 31 in accordance with transmission of USB 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−), the power terminal 312 (Power/VBUS), and the ground terminal 313 (Gnd) are retained. While for the second receptacle terminals 41 in accordance with transmission of USB 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−), the power terminal 412 (Power/VBUS), and the ground terminal 413 (Gnd) are retained. As described in the first embodiment, the number of the first receptacle terminals 31 or the second receptacle terminals 41 may be reduced from twelve to seven, without altering the terminal positions, for mating with an electrical plug connector and transmitting USB 2.0 signals (low-speed signals). Alternatively, as described in the third embodiment, the number of the first receptacle terminals 31 or the second receptacle terminals 41 may be increase to twelve for transmitting USB 3.0 signals (high-speed signals). Therefore, the electrical receptacle connector 100 may be applicable to different electrical plug connectors by adjusting the number of the receptacle terminals.

Please refer to FIGS. 14 to 16. Furthermore, the rightmost ground terminal 313 may be replaced by a power terminal 312 and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the second first terminal 311 and an electrical receptacle connector 100 having the power terminal 312 (Power/VBUS) can be provided for large current transmission.

Please refer to FIGS. 14 to 16. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Based on the above, the tail portion of the power terminal of the first receptacle terminals and the tail portion of the power terminal of the second receptacle terminals are adjacent to and combined with each other, the tail portion of the power terminal of the first receptacle terminals and the tail portion of the power terminal of the second receptacle terminals are inserted into the same second soldering hole. Consequently, the cost and time for the soldering procedure of the connector manufacturing can be reduced. Alternatively, the tail portion of the ground terminal of the first receptacle terminals and the tail portion of the ground terminal of the second receptacle terminals are adjacent to and combined with each other, the tail portion of the ground terminal of the first receptacle terminals and the tail portion of the ground terminal of the second receptacle terminals are inserted into the same second soldering hole. Consequently, the cost and time for the soldering procedure of the connector manufacturing can be reduced. In a further option, the tail portion of the power terminal of the first receptacle terminals and the tail portion of the power terminal of the second receptacle terminals are adjacent to and combined with each other, the tail portion of the ground terminal of the first receptacle terminals and the tail portion of the ground terminal of the second receptacle terminals are adjacent to and combined with each other, and the four pins are inserted into the same second soldering hole. Consequently, the cost and time for the soldering procedure of the connector manufacturing can be further reduced.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, comprising a shell body and a receptacle cavity defined in the shell body;

an insulated housing received in the receptacle cavity of the metallic shell, wherein the insulated housing comprises a base portion and a tongue portion extending from one of two sides of the base portion, the tongue portion has a first surface and a second surface, and the first surface is opposite to the second surface;

a plurality of first receptacle terminals comprising a plurality of first signal terminals, at least one power terminal, and at least one ground terminal, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction and extending out of the base portion, and wherein the tail portion of the power terminal is substantially perpendicularly extending from the body portion and extending out of the base portion, and the tail portion of the ground terminal is substantially perpendicularly extending from the body portion and extending out of the base portion; and a plurality of second receptacle terminals comprising a plurality of second signal terminals, at least one power terminal, and at least one ground terminal, wherein each of the second receptacle terminals is held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion, wherein the tail portion of the power terminal is substantially perpendicularly extending from the body portion and extending out of the base portion, and the tail portion of the power terminal of the second receptacle terminals is adjacent to and combined with the tail portion of the power terminal of the first receptacle terminals, and wherein the tail portion of the ground terminal is substantially perpendicularly extending from the body portion and extending out of the base portion, and the tail portion of the ground terminal of the second receptacle terminals is adjacent to and combined with the tail portion of the ground terminal of the first receptacle terminals.

2. The electrical receptacle connector according to claim 1, wherein one surface of the tail portion of the power terminal of the second receptacle terminals is in contact with one surface of the tail portion of the power terminal of the first receptacle terminals.

3. The electrical receptacle connector according to claim 1, wherein one surface of the tail portion of the ground terminal of the second receptacle terminals is in contact with one surface of the tail portion of the ground terminal of the first receptacle terminals.

4. The electrical receptacle connector according to claim 1, wherein one surface of the tail portion of the power terminal of the second receptacle terminals is spaced from one surface of the tail portion of the power terminal of the first receptacle terminals by a gap.

5. The electrical receptacle connector according to claim 1, wherein one surface of the tail portion of the ground terminal of the second receptacle terminals is spaced from one surface of the tail portion of the ground terminal of the first receptacle terminals by a gap.

6. The electrical receptacle connector according to claim 1, further comprising a circuit board, wherein the circuit board comprises a plurality of first soldering holes and a plurality of second soldering holes, except the tail portion of the power terminal and the tail portion of the ground terminal of the first receptacle terminals and except the tail portion of the power terminal and the tail portion of the ground terminal of the second receptacle terminals, rest of the tail portions of the first receptacle terminals and the tail portions of the second receptacle terminals are inserted into the first soldering holes, and the tail portion of the power terminal and the tail portion of the ground terminal of the first receptacle terminals and the tail portion of the power terminal and the tail portion of the ground terminal of the second receptacle terminals are inserted into the second soldering holes.

7. The electrical receptacle connector according to claim 6, wherein the diameter of each of the first soldering holes is less than the diameter of each of the second soldering holes.

8. The electrical receptacle connector according to claim 1, further comprising a grounding plate at the insulated housing, wherein the grounding plate comprises a plate body and a plurality of legs, the plate body is between the flat contact portions of the first receptacle terminals and the flat contact portions of the second receptacle terminals, the legs are extending outward from two sides of the plate body and extending out of the insulated housing.

9. The electrical receptacle connector according to claim 8, wherein each of the legs of the grounding plate is adjacent to and combined with at least one of the tail portion of the power terminal of the first receptacle terminals and the tail portion of the power terminal of the second receptacle terminals.

10. The electrical receptacle connector according to claim 8, wherein each of the legs of the grounding plate is adjacent to and combined with at least one of the tail portion of the ground terminal of the first receptacle terminals and the tail portion of the ground terminal of the second receptacle terminals.

11. The electrical receptacle connector according to claim 1, wherein the first receptacle terminals and the second receptacle terminals have 180 degree symmetrical design with respect to a central point of the receptacle cavity as the symmetrical center.

12. The electrical receptacle connector according to claim 1, wherein the position of the flat contact portions of the first receptacle terminals corresponds to the position of the flat contact portions of the second receptacle terminals.

13. An electrical receptacle connector, comprising:

a metallic shell, comprising a shell body and a receptacle cavity defined in the shell body;

an insulated housing received in the receptacle cavity of the metallic shell, wherein the insulated housing comprises a base portion and a tongue portion extending from one of two sides of the base portion, the tongue portion has a first surface and a second surface, and the first surface is opposite to the second surface;

a plurality of first receptacle terminals comprising a plurality of first signal terminals, at least one power terminal, and at least one ground terminal, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction and extending out of the base portion, and wherein the tail portion of the power terminal is substantially perpendicularly extending from the body portion and extending out of the base portion; and a plurality of second receptacle terminals comprising a plurality of second signal terminals, at least one power terminal, and at least one ground terminal, wherein each of the second receptacle terminals is held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion, and wherein the tail portion of the power terminal is substantially perpendicularly extending from the body portion and extending out of the base portion, and the tail portion of the power terminal of the second receptacle terminals is adjacent to and combined with the tail portion of the power terminal of the first receptacle terminals.

14. An electrical receptacle connector, comprising:

a metallic shell, comprising a shell body and a receptacle cavity defined in the shell body;

an insulated housing received in the receptacle cavity of the metallic shell, wherein the insulated housing comprises a base portion and a tongue portion extending from one of two sides of the base portion, the tongue portion has a first surface and a second surface, and the first surface is opposite to the second surface;

a plurality of first receptacle terminals comprising a plurality of first signal terminals, at least one power terminal, and at least one ground terminal, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction and extending out of the base portion, and wherein the tail portion of the ground terminal is substantially perpendicularly extending from the body portion and extending out of the base portion; and a plurality of second receptacle terminals comprising a plurality of second signal terminals, at least one power terminal, and at least one ground terminal, wherein each of the second receptacle terminals is held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion, and wherein the tail portion of the ground terminal is substantially perpendicularly extending from the body portion and extending out of the base portion, and the tail portion of the ground terminal of the second receptacle terminals is adjacent to and combined with the tail portion of the ground terminal of the first receptacle terminals.

* * * * *